US009695626B2

(12) United States Patent
Shim et al.

(10) Patent No.: US 9,695,626 B2
(45) Date of Patent: Jul. 4, 2017

(54) DOOR FOR REFRIGERATOR AND METHOD FOR MANUFACTURING THE SAME, METAL CONTAINER AND METHOD FOR MANUFACTURING THE SAME, AND APPARATUS AND METHOD FOR PROCESSING METAL SHEET

(71) Applicant: LG Electronics Inc., Seoul (KR)

(72) Inventors: Jinwoo Shim, Gyeongsangnam-do (KR); Youngki Ko, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 231 days.

(21) Appl. No.: 14/264,099

(22) Filed: Apr. 29, 2014

(65) Prior Publication Data

US 2014/0230337 A1 Aug. 21, 2014

Related U.S. Application Data

(62) Division of application No. 13/914,801, filed on Jun. 11, 2013, now Pat. No. 9,074,405.

(30) Foreign Application Priority Data

Jun. 12, 2012 (KR) ..... 10-2012-0062678

(51) Int. Cl.
*F25D 23/02* (2006.01)
*B21D 22/20* (2006.01)
(Continued)

(52) U.S. Cl.
CPC ..... *E06B 1/12* (2013.01); *B21D 22/205* (2013.01); *F25D 23/02* (2013.01); *F25D 23/028* (2013.01); *B21D 45/06* (2013.01); *B21D 51/52* (2013.01)

(58) Field of Classification Search
CPC . B21D 22/205; B21D 26/21; Y10T 29/49805; Y10T 29/4998; Y10T 29/49982;
(Continued)

(56) References Cited

U.S. PATENT DOCUMENTS 1,905,853 A * 4/1933 Griffiths ..... F25D 23/06 300/20
2,718,446 A 9/1955 Hinkel
(Continued)

FOREIGN PATENT DOCUMENTS

DE 10 2012 106299 A1 1/2013
JP S 57-139269 A 8/1982
(Continued)

OTHER PUBLICATIONS

US Office Action dated Sep. 8, 2014 for U.S. Appl. No. 13/914,801, 15 pages.
(Continued)

*Primary Examiner* — David Bryant
*Assistant Examiner* — Lawrence Averick
(74) *Attorney, Agent, or Firm* — Fish & Richardson P.C.

(57) ABSTRACT

Provided is a door for a refrigerator. The door includes an outer door manufactured by pressing and deforming a metal sheet. The outer door includes a first surface, second to fifth surfaces extending from the first surface, and a plurality of flanges extending from the second to fifth surfaces. The first to fifth surfaces are integrated with each other and defined based on the pressing and deforming of the metal sheet. A door liner is coupled to surfaces of the plurality of flanges of the outer door, and an insulation material is disposed in a space defined between the door liner and the outer door.

10 Claims, 9 Drawing Sheets

(51) Int. Cl.
*E06B 1/12* (2006.01)
*B21D 45/06* (2006.01)
*B21D 51/52* (2006.01)

(58) Field of Classification Search
CPC ..... F03D 1/001; F03D 11/04; F05B 2230/60; F05B 2240/912; B65D 81/38; E06B 3/96; E06B 7/16; F16B 12/02; F16B 5/00; F25D 23/06; F25D 23/12
USPC ..... 49/506; 416/DIG. 6, 5, 244 R
See application file for complete search history.

(56) References Cited

U.S. PATENT DOCUMENTS

| | | | | |
|---|---|---|---|---|
| 3,137,744 | A | 6/1964 | Burrus | |
| 3,403,477 | A | 10/1968 | Light | |
| 3,598,463 | A | 8/1971 | Kesling | |
| 3,882,637 | A | 5/1975 | Lindenschmidt | |
| 4,053,972 | A | 10/1977 | Kordes | |
| 4,134,626 | A | 1/1979 | Kordes | |
| 4,484,703 | A * | 11/1984 | Kawasaki | B21D 53/00 228/144 |
| 5,533,311 | A | 7/1996 | Tirrell | |
| 5,716,581 | A | 2/1998 | Tirrell | |
| 5,759,591 | A | 6/1998 | Rhoades | |
| 5,909,937 | A | 6/1999 | Jenkins | |
| 6,138,432 | A | 10/2000 | Banicevic | |
| 6,192,630 | B1 | 2/2001 | Banicevic | |
| 6,209,265 | B1 | 4/2001 | Banicevic | |
| 6,779,859 | B2 * | 8/2004 | Koons | F25D 23/021 312/405 |
| 6,961,988 | B2 | 11/2005 | Koons | |
| 7,862,323 | B2 | 1/2011 | Micarelli | |
| 7,886,500 | B2 * | 2/2011 | Leimkuehler | F25D 23/02 312/405 |
| 8,534,106 | B2 * | 9/2013 | Golovashchenko | B21D 22/205 29/421.1 |
| 9,074,405 | B2 | 7/2015 | Shim et al. | |
| 2001/0023603 | A1 | 9/2001 | Yoshioka | |
| 2002/0190617 | A1 * | 12/2002 | Banicevic | F25D 23/02 312/321.5 |
| 2003/0173883 | A1 | 9/2003 | Boons | |
| 2004/0079128 | A1 | 4/2004 | Kusunoki et al. | |
| 2006/0028105 | A1 * | 2/2006 | Rasche | F25D 23/02 312/405 |
| 2007/0039370 | A1 * | 2/2007 | Kruger | B21D 26/055 72/451 |
| 2010/0187291 | A1 | 7/2010 | Kriegner | |
| 2011/0088442 | A1 * | 4/2011 | Golovashchenko | B21D 22/205 72/60 |

FOREIGN PATENT DOCUMENTS

| | | | |
|---|---|---|---|
| JP | S 60-103524 | | 6/1985 |
| JP | S 61-046885 | A | 3/1986 |
| JP | H 02-025678 | A | 1/1990 |
| JP | H 08-121945 | A | 5/1996 |
| JP | H 09-057381 | A | 3/1997 |
| JP | 2008-036658 | A | 2/2008 |
| JP | 2008-044232 | A | 2/2008 |
| WO | WO 2011/060502 | A1 | 5/2011 |

OTHER PUBLICATIONS

U.S. Office Action dated Dec. 1, 2014 for U.S. Appl. No. 13/914,801, 10 pages.
Japanese Office Action dated Dec. 22, 2014 for Application No. JP 2013-123545 with English Translation, 4 pages.
Chinese Office Action and Search Report dated Feb. 4, 2015 for Application No. CN 201310232684.3, with English Translation, 15 pages.
US Office Action dated Apr. 21, 2014 for U.S. Appl. No. 13/914,801, 9 pages.
Extended European Search Report issued in European Application No. 13171398.4 on Feb. 2, 2016, 9 pages.
Japanese Office Action dated Mar. 20, 2014 for Application No. 2013-123545 with English Translation, 14 Pages.

* cited by examiner

DOOR FOR REFRIGERATOR AND METHOD FOR MANUFACTURING THE SAME, METAL CONTAINER AND METHOD FOR MANUFACTURING THE SAME, AND APPARATUS AND METHOD FOR PROCESSING METAL SHEET

CROSS-REFERENCE TO RELATED APPLICATIONS

This application is a divisional of U.S. application Ser. No. 13/914,801, filed Jun. 11, 2013, now pending, which claims priority under 35 U.S.C. 119 and 35 U.S.C. 365 to Korean Patent Application No. 10-2012-0062678 (filed on Jun. 12, 2012), the entire content of the prior applications is hereby incorporated by reference.

FIELD

The present disclosure relates to a door for a refrigerator and a method for manufacturing the same, a metal container and a method for manufacturing the same, and an apparatus and method for processing a metal sheet.

BACKGROUND

In general, a metal sheet may be processed by being pressed using a press mold. However, when the metal sheet has four corners and each of four corners of the press mold has a small radius, the metal sheet may be torn during the processing of the metal sheet.

In a case where a door for a refrigerator is manufactured by using a metal sheet, four corners of the metal sheet may be chamfered and then vertically bent to form side portions. Then, the four side portions are welded to connect the four side portions to each other. Thereafter, boundaries of the four side portions are chamfered, and then portions of the four side portions are folded inward to form flange parts, thereby manufacturing an outer door. According to the above-described processing method, since four side portions of the door for the refrigerator are coupled to each other by welding, if a portion that is not welded exists, a foam agent may leak. Also, welding the four side portions to each other may be time consuming in the manufacturing process.

Also, a foam agent is injected into the outer door manufactured through the above-described method. Since four side portions of the outer door are welded, the outer door may be deformed while a foam agent expands after being injected. Thus, an entire surface of the outer door may be seated on a foam jig to prevent deformation of the outer door by using the foam jig.

However, the foam agent is injected in the state where the entire surface of the outer door is seated on the foam jig. Thus, if contaminants exist on the outer door, shapes corresponding to the contaminants may be formed on the outer door, thereby damaging an outer appearance of the outer door.

In another example, when a door for a refrigerator is manufactured, two side surfaces facing a front surface of the outer door may be integrated with each other, and then, a separate deco member for forming top and bottom surfaces is coupled to the outer door. Then, a foam agent is injected into the outer door. However, according to this manufacturing method of the door, a gap between the deco member and the outer door may occur based on pressure caused by expansion of the foam agent injected into the door. As a result, the foam agent may leak, or aesthetic appearance may be reduced.

SUMMARY

In one aspect, a door for a refrigerator includes an outer door manufactured by pressing and deforming a metal sheet. The outer door includes a first surface, second to fifth surfaces extending from the first surface, and a plurality of flanges extending from the second to fifth surfaces. The first to fifth surfaces are integrated with each other and are defined based on the pressing and deforming of the metal sheet. The door for the refrigerator also includes a door liner coupled to surfaces of the plurality of flanges of the outer door and an insulation material disposed in a space defined between the door liner and the outer door.

Implementations may include one or more of the following features. For example, the first surface may define a front surface of the outer door, the second surface and the third surface may face each other and may define side surfaces of the outer door, the fourth surface may define a bottom surface of the outer door, and the fifth surface may face the fourth surface and may define a top surface of the outer door.

The outer door may be manufactured by performing a hydro forming process on the metal plate. The second to fifth surfaces may be pressed and deformed by a liquid disposed into a mold frame in processing the outer door. The metal sheet may be primarily and secondarily pressed to manufacture the first to fifth surfaces.

In addition, each of the plurality of flanges may be bent toward a center of the outer door. The plurality of flanges may contain four flanges, and each of the four flanges may extend toward one of the second to fourth surfaces.

In some implementations, the door may include a packing disposed between each pair of adjacent flanges. In these implementations, the packing may be configured to block leakage of a foam agent inserted between the second to fourth surfaces. Further, the door may include a gasket disposed on an edge part of the door liner and configured to create a seal based on the door contacting a refrigerator cabinet in a closed position.

In another aspect, a method for manufacturing a door includes pressing and deforming a metal plate to manufacture an outer door of which a front surface, both side surfaces, a top surface, and a bottom surface are integrated with each other. The method also includes removing a mold fixing part that fixes the outer door during the pressing and deforming of the metal plate and bending edges of the side surfaces, the top surface, and the bottom surface of the outer door to define flanges at the side surfaces, the top surface, and the bottom surface of the outer door. The method further includes, after defining the flanges at the side surfaces, the top surface, and the bottom surface of the outer door, injecting a foam agent into a space defined by the outer door.

Implementations may include one or more of the following features. For example, the method may include coupling a door liner to the outer door after injecting the foam agent. In this example, the method may include coupling, to the door liner, a gasket configured to create a seal based on the door contacting a refrigerator cabinet in a closed position.

The method may include, prior to injecting the foam agent, installing a packing between each pair of adjacent flanges. The packing may be configured to block leakage of the foam agent injected into the space defined by the outer door.

In some implementations, the method may include coupling a door liner to the outer door before injecting the foam agent. In these implementations, the method may include injecting the foam agent into a space defined between the outer door and the door liner through a hole of the door liner.

In addition, the method may include chamfering portions of boundaries of the side surfaces, the top surface, and the bottom surface and, after chamfering, bending a portion of each of the side surfaces, the top surface, and the bottom surface inwardly. Further, the method may include using a hydro forming process to press and deform the metal plate.

In yet another aspect, a metal container includes a bottom part manufactured by pressing a metal plate using a first mold. The metal container also includes a circumferential part manufactured by bending and deforming a portion of the metal sheet through pressing using a second mold and liquid injected into a mold frame that holds the metal plate.

Implementations may include one or more of the following features. For example, the circumferential part may include a plurality of surfaces bent and extending from the bottom part. The bottom part may be a first surface and the circumferential part may be integrated with the first surface and may include second to fourth surfaces bent from the bottom part.

In a further aspect, a method for manufacturing a metal container includes obtaining a counter mold that defines a space in which a liquid is accommodated and fixing a metal sheet on a mold frame. The method also includes injecting the liquid into the space defined by the counter mold to contact the metal sheet fixed on the mold frame. The method further includes pressing the metal sheet using a press mold, the liquid, and the counter mold, thereby deforming the metal sheet using the liquid, the press mold, and the counter mold at the same time.

In yet another aspect, a method for processing a metal sheet includes disposing a metal sheet on a mold having a space that accommodates a liquid and injecting the liquid into the space. The method also includes, after injecting the liquid into the space, deforming the metal sheet by pressing the metal sheet with a press mold, a counter mold, and the liquid.

Implementations may include one or more of the following features. For example, a contact area between the liquid and the metal sheet may be less than a contact area between the counter mold and the metal sheet. The method may include bending the metal sheet, and using the liquid to apply a pressure to the metal sheet at bent portions of the metal sheet.

In addition, the method may include using the liquid to apply a pressure to the metal sheet at an outer area of an O-ring provided on the counter mold. Further, the method may include deforming the deformed metal sheet again using another press mold that is different from the press mold and the counter mold. A corner part of the press mold may have a radius greater than that of a corner part of the other press mold, which has a different shape than the press mold.

In some examples, the method may include, after the deformation is performed, separating the press mold from the mold frame. In these examples, the method may include supplying air between the press mold and the metal sheet while the press mold is separated from the mold frame.

In another aspect, an apparatus for processing a metal sheet includes a mold frame having a space that accommodates a liquid and a press mold configured to press a metal sheet placed on the mold frame. The apparatus also includes a counter mold configured to press the metal sheet on a side opposite to the press mold. At least one air passage through which air is supplied between the metal sheet and the press mold is defined in the press mold.

Implementations may include one or more of the following features. For example, the counter mold and the press mold may be configured to move to deform the metal sheet in a state where the counter mold and the press mold contact the metal sheet at the same time.

The apparatus may include a liquid pressure adjustment unit configured to supply the liquid. The liquid pressure adjustment unit may adjust a pressure of the liquid within the space. The counter mold may include an O-ring configured to block the liquid from being introduced between the metal sheet and the counter mold. The liquid may apply a pressure to the metal sheet at a corner part of the metal sheet.

The details of one or more implementations are set forth in the accompanying drawings and the description below. Other features will be apparent from the description and drawings, and from the claims.

DETAILED DESCRIPTION

Figure 1:
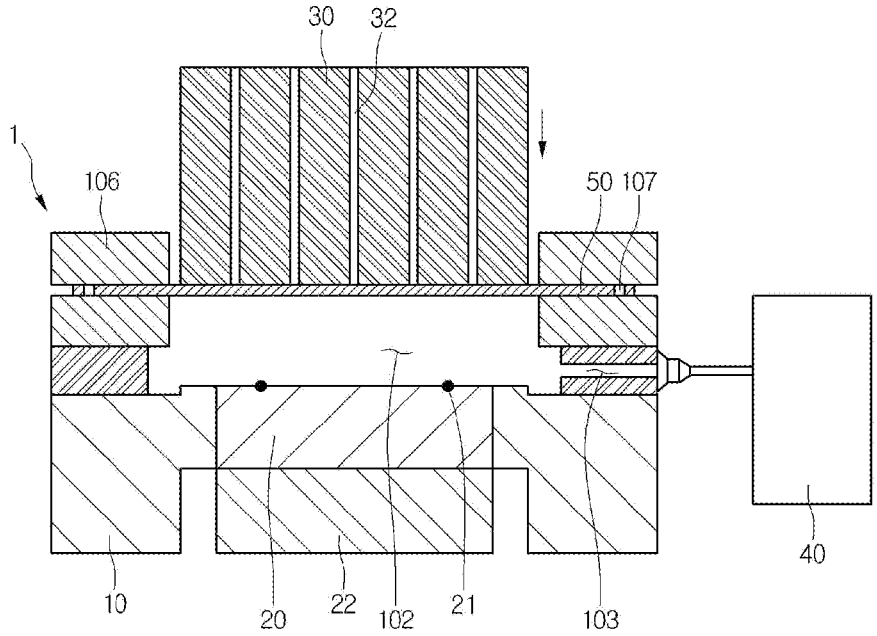
FIG. 1 is a view of an example apparatus for processing a metal sheet.
Figure 2:
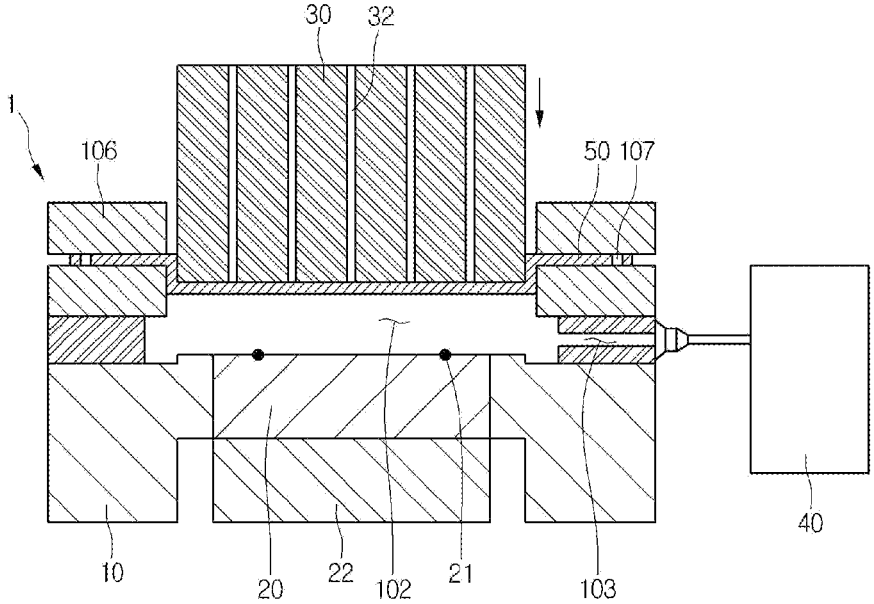
FIG. 2 is a view of the example apparatus for processing the metal sheet in a state where the metal sheet is pressed by a first press mold.
Figure 3:
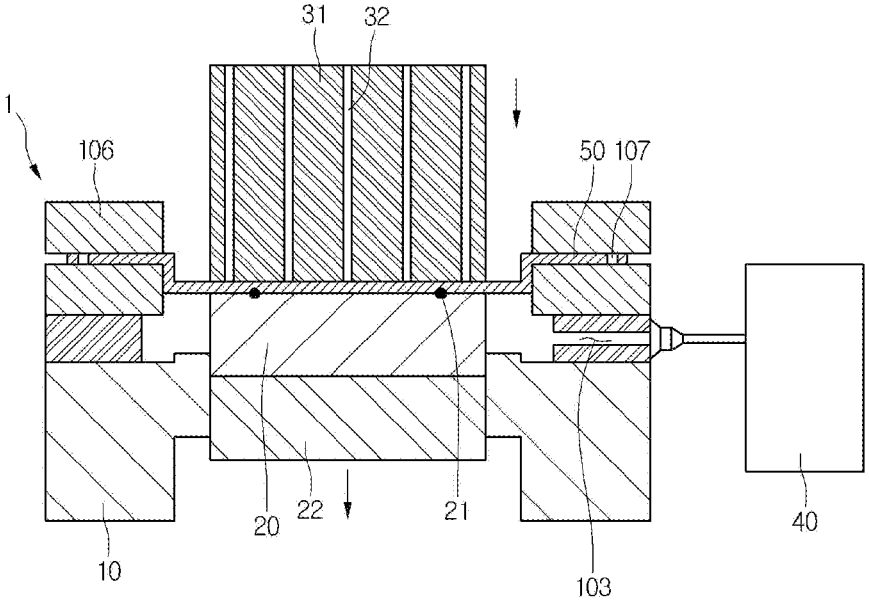
FIGS. 3 to 5 are views illustrating an example process of molding the metal sheet by a second press mold and a liquid.
Figure 4:
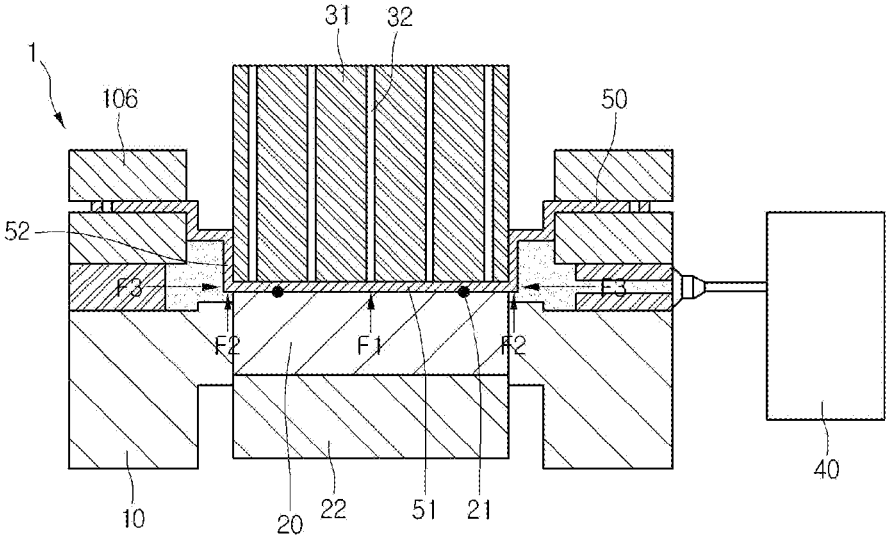
Figure 5:
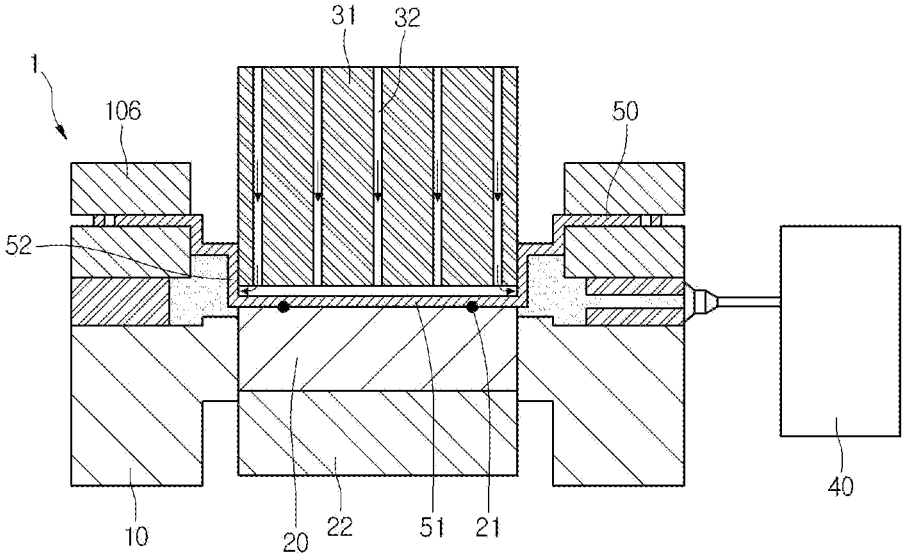

FIG. 1 illustrates an example apparatus for processing a metal sheet, FIG. 2 illustrates the example apparatus for processing the metal sheet in a state where the metal sheet is pressed by a first press mold, and FIGS. 3 to 5 illustrate an example process of molding the metal sheet by a second press mold and a liquid.

Referring to FIGS. 1 to 5, a processing apparatus 1 may include a mold frame 10 for processing a metal sheet 50 in a predetermined shape. The mold frame 10 has a space (or groove) 102 having a predetermined shape. The space 102 may vary in shape depending on a shape of the metal sheet desired. For instance, the metal sheet 50 may be processed in the same shape as that of the space 102.

The processing apparatus 1 may further include a first press mold 30 for pressing the metal sheet 50. For example, the first press mold 30 may press the metal sheet 50 while the first press mold 30 moves downward from an upper side of the metal sheet 50. In this example, the first press mold 30 may be taken in or out of the space 102.

The first press mold 30 has at least one air passage 32 through which air flows. For example, the air passage 32 extends vertically within the first press mold 30. Also, air above the air passage 32 may contact the metal sheet 50 in a state where the first press mold 30 presses the metal sheet 50.

The processing apparatus 1 may further include a counter mold 20 pressing the metal sheet 50 and a driving part 22 vertically moving the counter mold 20. The counter mold 20 and the driving part 22 will be described in more detail below.

The mold frame 10 may be connected to a liquid pressure adjustment unit 40 supplying a liquid into the space 102. The mold frame 10 has a liquid passage 103 through which the liquid flows. The liquid pressure adjustment unit 40 may supply the liquid into the space 102 or recover the liquid supplied into the space 102. Also, the liquid pressure adjustment unit 40 may adjust a liquid pressure (e.g., hydraulic pressure) applied to the metal sheet 50 when the metal sheet 50 is processed.

The mold frame 10 may further include a holder 106 fixing the metal sheet 50. The holder 106 may be separate from the mold frame 10.

The holder 106 includes a fixing part 107 fixing an end of the metal sheet 50. Thus, the metal sheet 50 may be pressed and deformed in a state where the end thereof is fixed to a predetermined position.

Figure 6:
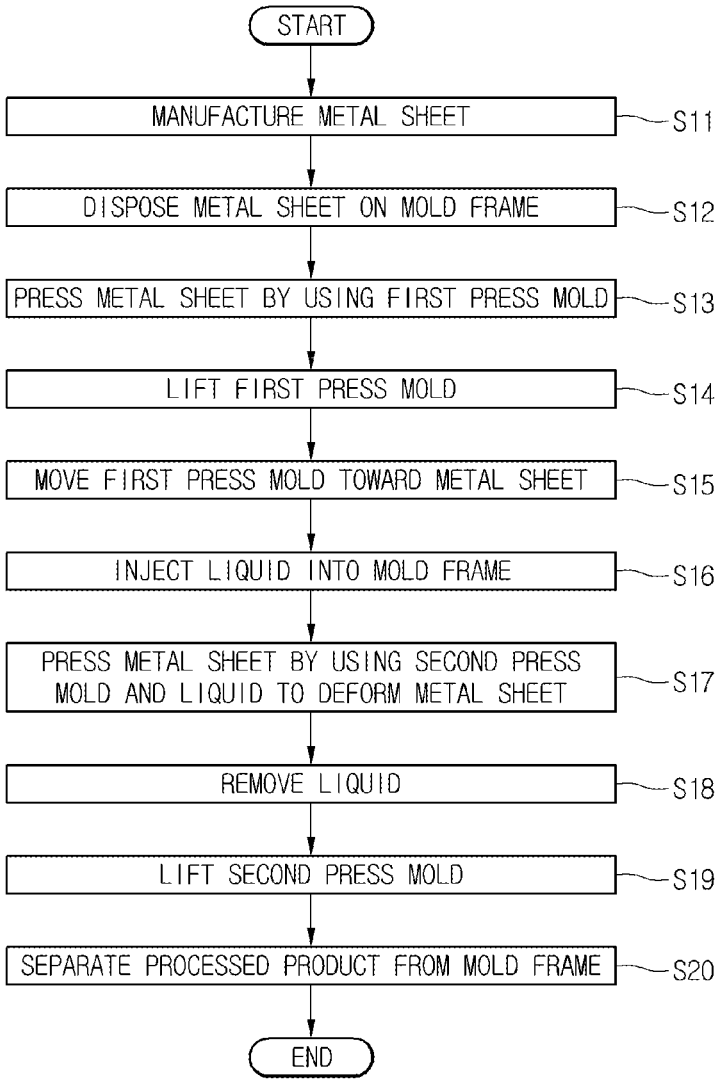
FIGS. 6 and 7 are flowcharts of an example method for processing the metal sheet.
Figure 7:
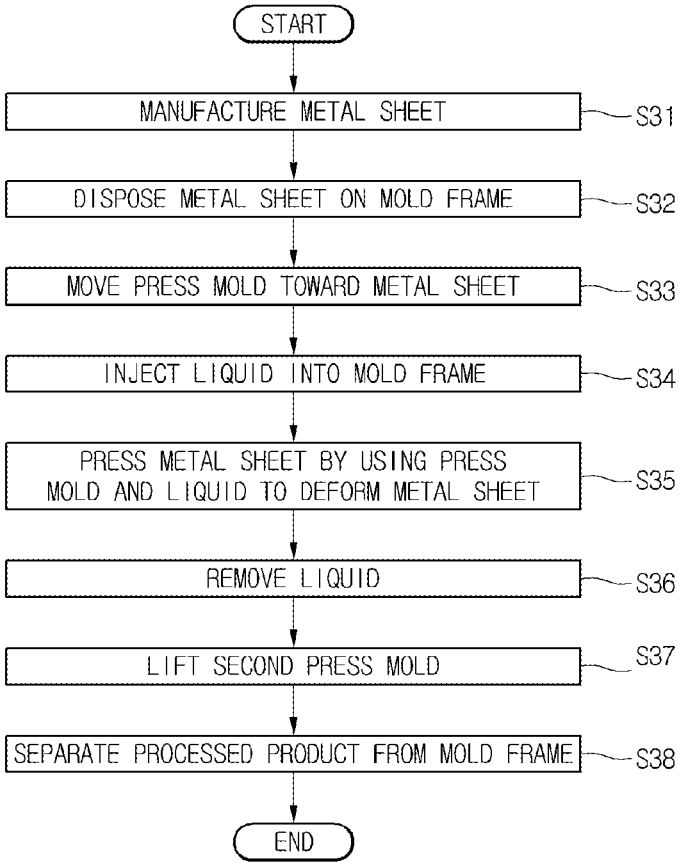

FIGS. 6 and 7 illustrate example methods for processing the metal sheet. FIG. 6 illustrates an example method for processing the metal sheet using one press mold, and FIG. 7 illustrates an example method for processing the metal sheet using a plurality of press molds.

Referring to FIGS. 1 to 6, a metal sheet 50 having a predetermined size is prepared (S11).

Then, the metal sheet 50 is disposed on the mold frame 10 (S12) (see FIG. 1). Also, the metal sheet 50 is fixed to the mold frame 10 by using the holder 106.

Then, the first press mold 30 moves toward the metal sheet 50 to press the metal sheet 50 (S13) (see FIG. 2). The first press mold (30) ascends (S14). In this example, a liquid is not injected into the mold frame 10 while the metal sheet 50 is processed using the first press mold 30.

Since the air exists above the air passage 32, when the first press mold 30 ascends and, thus, is spaced apart from the processed metal sheet 50, the air existing above the air passage 32 is supplied between the first press mold 30 and the metal sheet 50.

The metal sheet 50 is primarily molded by the operations S11 to S14.

Then, a second press mold 31 moves toward the metal sheet 50 (S15). The second press mold 31 is closely attached to a top surface of the metal sheet 50 that is primarily molded. Also, the driving part 22 moves to closely attach the counter mold 20 to a bottom part 51 of the metal sheet 50 (see FIG. 3).

In some examples, the second press mold 31 and the counter mold 20 will descend together with each other to press the metal sheet 50 (see FIG. 4).

A liquid is injected into the mold frame 10 (S16). That is, the liquid discharged from the liquid pressure adjustment unit 40 is filled into the space 102 through the liquid passage 103.

Then, the metal sheet 50 is deformed by the pressing of the second press mold 31, the counter mold 20, and the liquid (S17). In some examples, the second press mold 31 and the counter mold 20 descend together with each other to press the metal sheet 50 (see FIG. 4).

The metal sheet 50 is pressed by the second press mold 31 and the counter mold 20 at the same time (see FIG. 4). Simultaneously, the liquid disposed on the surroundings of the bottom part 51 of the metal sheet 50 presses the metal sheet 50 (see FIGS. 4 and 5) to bend and deform the metal sheet 50, thereby manufacturing a circumferential part 52 (e.g., an edge part or side part) of the metal sheet 50.

In some implementations, an O-ring 21 may be disposed on the counter mold 20 to prevent the liquid from being introduced between the counter mold 20 and the metal sheet 50. The O-ring 21 may have a loop shape. Thus, pressing force of the liquid may be applied into the metal sheet 50 in an outward direction of the O-ring 21.

That is, the metal sheet 50 is pressed by the counter mold 20 and the second press mold 31 to manufacture the bottom part 51. Also, the metal sheet 50 is pressed by the second mold 31 and the liquid at the same time to manufacture the circumferential part 52 in which a portion except for the bottom part 51 is bent.

Then, the liquid within the mold frame 10 is removed (S18) and the second press mold 31 ascends (S19). Here, since air exists above the air passage 32, when the second press mold 31 ascends and, thus, is spaced apart from the processed metal sheet 50, the air existing above the air passage 32 is supplied between the second press mold 31 and the metal sheet 50 (see FIG. 5).

Then, the processed product is separated from the mold frame 10 (S20).

In some examples, the metal sheet 50 may be deformed into the processed product through hydro forming. In addition, the metal sheet 50 may be deformed into the processed product by a partial hydro forming method (e.g., because the liquid pressure is applied in an outer region of the O-ring).

In some implementations, a contact area between the counter mold 20 and the metal sheet 50 may be greater than that between the liquid and the metal sheet 50.

A time point at which the liquid injected into the mold frame 10 is removed is not limited to the time point described in FIG. 6. For example, the liquid may be removed while the second press mold 31 ascends, after the second press mold 31 completely ascends, while the processed product is separated from the mold frame 10, or after the processed product is completely separated.

In some examples, while the metal sheet 50 is processed, the pressing force of the liquid is not applied to the whole bottom part 51 of the metal sheet 50, but is applied to only the circumferential part or a portion of the bottom part 51 and the circumferential part (which correspond to an outer region of the O-ring). Thus, when compared to a case in which the liquid is applied to an entire surface of the metal sheet 50, pressing force of the second press mold 31 pressing the metal sheet 50 from an upper side of the metal sheet 50 is relative low. Accordingly, the processing apparatus for processing the metal sheet having the same size may be reduced in volume.

Also, since a portion of the metal sheet 50 is pressed and bent by the liquid to manufacture the circumferential part, a boundary between two circumferential parts adjacent to each other may be minimized in radius.

Further, while the second press mold 31 is separated from the mold frame 10, since air is supplied between the second press mold 31 and the metal sheet 50 through the air passage 32 of the second press mold 31, the processed metal sheet 50 may be maintained in the shape formed through pressing.

If the air passage is not defined in the second press mold 31, a fine space between the second press mold 31 and the processed metal sheet 50 may be in a vacuum state (or a state similar to the vacuum state). Thus, a portion of the bottom part 51 of the processed metal sheet 50 may ascend along the second press mold 31 to deform the bottom part 51.

Also, since the metal sheet 50 is processed into the bottom part 51 and the four circumferential parts (or side parts) 52 by the processing apparatus 1, it may be unnecessary to weld the four side parts to each other.

Referring to FIG. 7, the metal sheet 50 may be processed using one press mold. Here, the first or second press mold may be selectively used according to a use of the processed product.

First, a metal sheet 50 having a predetermined size is prepared (S31). Then, the metal sheet 50 is disposed on the mold frame 10 (S32). The metal sheet 50 is fixed to the mold frame 10 by using the holder 106. Then, one of the press molds 30 and 31 moves toward the metal sheet 50 (S33). The counter mold 20 also is moved to be closely attached to a lower portion of the metal sheet 50.

Also, while the one of the press molds 30 and 31 and the counter mold 20 move toward the metal sheet 50, a liquid is injected into the mold frame 10 (S34).

Then, the metal sheet 50 is deformed by the pressing of the counter mold 20, the one of the press molds 30 and 31, and the liquid (S35).

Then, the liquid within the mold frame 10 is removed (S36). Also, the one of the press molds 30 and 31 ascends (S37). Here, since air exists above the air passage 32, when the one of the press molds 30 and 31 ascends and, thus, is spaced apart from the processed metal sheet 50, the air existing above the air passage 32 is supplied between the one of the press molds 30 and 31 and the metal sheet 50.

Then, the processed product is separated from the mold frame 10 (S38).

The plurality of press molds may be used as shown in FIG. 6, or a single press mold may be used as shown in FIG. 7 depending on the radius of the boundary between the two circumferential parts adjacent to each other of the processed product. When the plurality of press molds are used, the plurality of press molds may have shapes different from each other. That is, the second press mold 31 may have a radius less than that of the first press mold 30.

Figure 8:
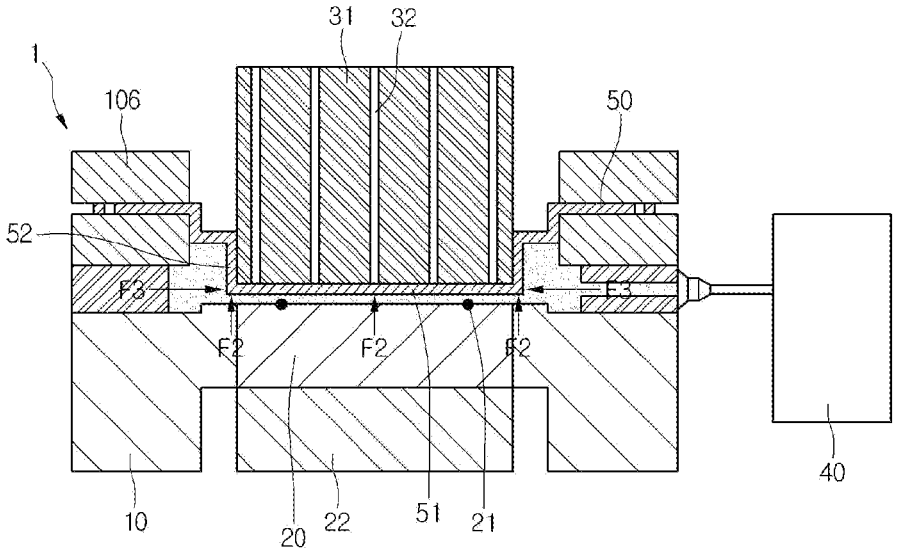
FIG. 8 is a view of another example method for processing a metal sheet.

FIG. 8 illustrates another example method for processing a metal sheet.

The method for processing a metal sheet in FIG. 8 is the same as that in FIG. 5, except that a liquid presses an entire bottom surface of the metal sheet. Thus, only unique portions of the method illustrated in FIG. 8 are discussed below.

Referring to FIG. 8, a second press mold 31 presses a metal sheet 50 in a state where a counter mold 20 is spaced apart from the metal sheet 50. When the second press mold 31 completely descends, the counter mold 20 may be spaced apart from the metal sheet 50. Thus, a liquid presses an entire surface of a bottom part 51 of the metal sheet 50.

Accordingly, when a processed product has a large corner radius or a small corner radius, the metal sheet 50 may be processed by a liquid pressure and a pressure of the press mold without using the counter mold 20.

Figure 9:
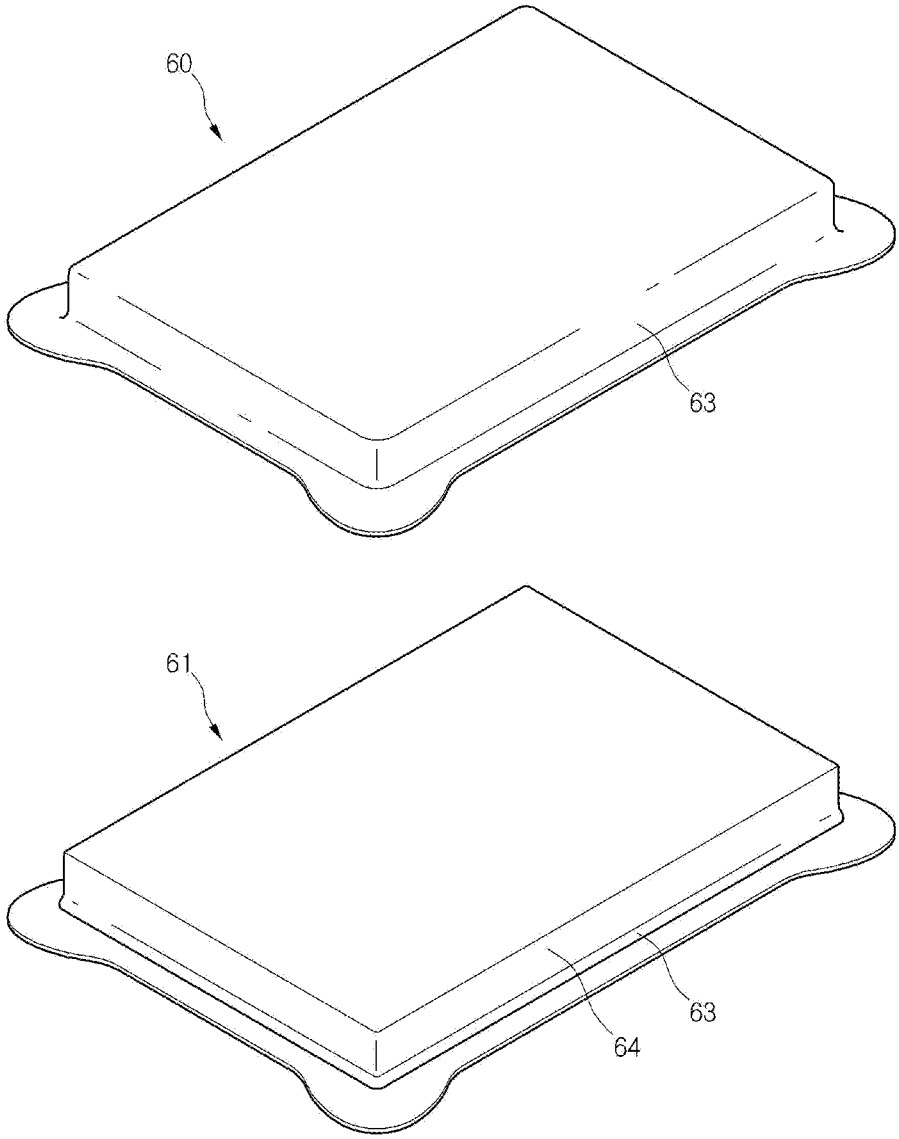
FIG. 9 is a view for comparing a first example processed product manufactured using one press mold to a second example processed product manufactured using a plurality of press molds.

FIG. 9 illustrates a comparison of a first example processed product manufactured using one press mold to a second example processed product manufactured using a plurality of press molds.

Referring to FIG. 9, in a case where one press mold is used, a processed product 60 includes one processed part 63. On the other hand, in a case where a plurality of press molds are used, a processed product 61 includes a plurality of processed parts 63 and 64.

Here, the first processed part 63 may be manufactured by the first press mold 30. In addition, the second processed part 64 may be manufactured by the second press mold 31. Each of two circumferential parts adjacent to each other of the second processed part 64 may be less than that of each of two circumferential parts adjacent to each other of the first processed part 63. This results because the first and second press molds 30 and 31 have shapes different from each other.

Next, an example method for manufacturing a door for a refrigerator by using the processed product that is processed by the processing apparatus will be described below.

Figure 10:
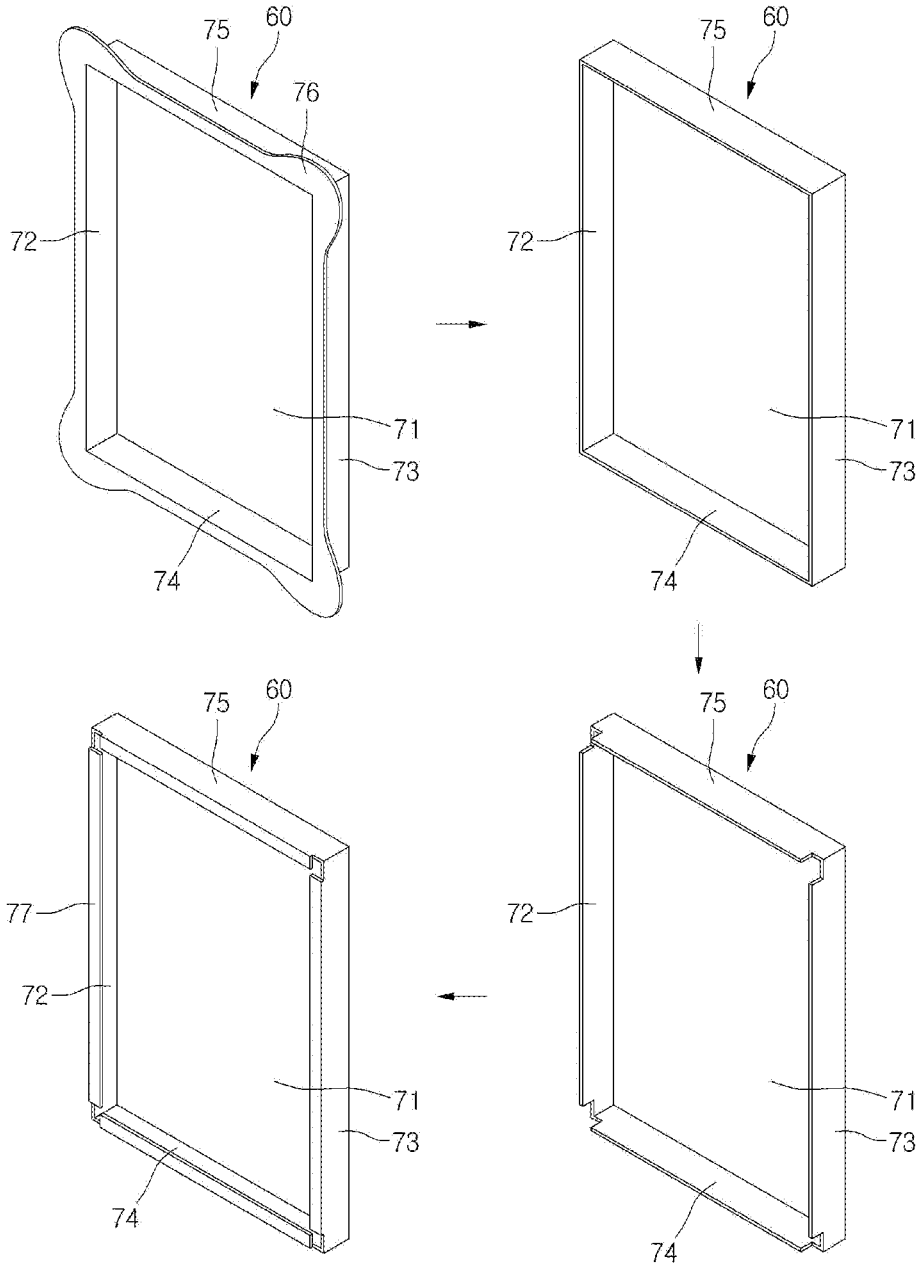
FIG. 10 is a view illustrating an example process of molding an outer door constituting a door for a refrigerator by using a processed product.
Figure 11:
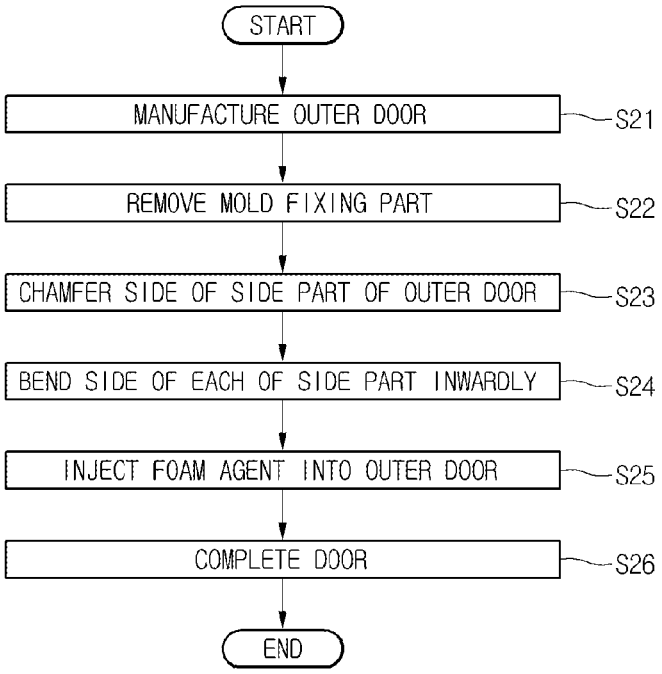
FIG. 11 is a flowchart of an example method for manufacturing the door for the refrigerator.
Figure 12:
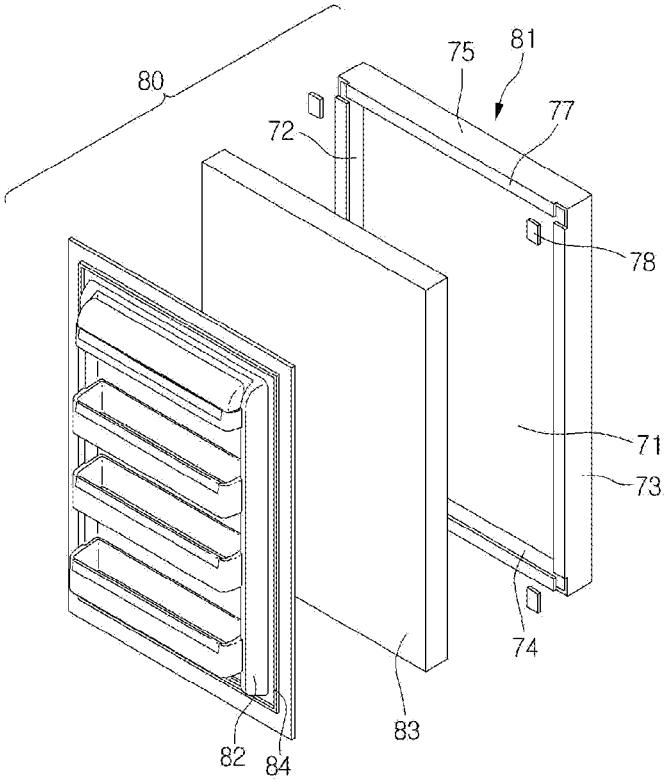
FIG. 12 is an exploded perspective view of the example door for the refrigerator.

FIG. 10 illustrates an example process of molding an outer door constituting a door for a refrigerator by using a processed product, FIG. 11 illustrates an example method for manufacturing the door for the refrigerator, and FIG. 12 illustrates the example door for the refrigerator.

Referring to FIGS. 10 to 12, to manufacture a door 80 for a refrigerator, an outer door 81 is manufactured first (S21). Here, the above-described processed product 60 may be used as the outdoor 81.

The processed product 60 that is processed by the processing apparatus 1 includes a first surface 71, a plurality of circumferential parts 72 to 75 extending vertically from the first surface 71, and a mold fixing part 76 extending from the plurality of circumferential parts 72 to 75. For example, the plurality of circumferential parts 72 to 75 may include four circumferential parts.

The four circumferential parts define second to fifth surfaces. The first surface 71, the second to fifth surfaces, and the mold fixing part 76 are integrated with each other. Also, the first surface and the second to fifth surfaces define a space in which a foam agent is injected.

When the processed product 60 is used as the outer door 81, the first surface 71 may be referred to as a front surface, the second surface 72 and the third surface 73 facing the second surface 72 may be referred to as side surfaces, a fourth surface 74 may be referred to as a bottom surface, and a fifth surface 75 may be referred to as a top surface.

Then, the mold fixing part 76 is removed from the outer door 81 (S22). Then, a boundary between two circumferential parts adjacent to each other is chamfered (S23). That is, four portions of the outer door 81 are chamfered. Then, a portion of the four circumferential parts are bent inward to form a flange 77 (S24). That is, the flange 77 may extend from the four circumferential parts.

Although the processed product is processed and then applied to the outer door constituting the door for the refrigerator, the present disclosure is not limited thereto. For instance, an object using the processed product may be called a metal container. Also, the processed product 60 may be manufactured as doors for other products in addition to the door for the refrigerator.

Then, the outer door 81 is disposed on a foam jig. Here, the foam jig may contact a minimum area of the outer door 81 to prevent the outer door 81 from moving. For example, the foam jig may include a first support supporting a portion of the bottom surface of the outer door 81 and a plurality of second supports supporting the side surfaces of the outer door 81.

Since the first surface and the second to fifth surfaces of the outer door 81 are integrated with each other, deformation of the outer door 81 may be prevented while the foam agent is injected and expanded. Thus, the contact area between the foam jig and the outer door 81 may be minimized. Thus, while the foam agent of the outer door expands, the outer door may minimally have an influence on contaminants on the foam jig.

The foam agent is injected into the outer door 81 (S25). In some examples, before the foam agent is injected into the outer door 81, a packing 78 may be coupled to prevent the foam agent injected into a space between the flanges 77 adjacent to each other on the outer door 81 from leaking.

Also, when the injected foam agent is cured, the door 80 for the refrigerator is completely manufactured (S26). The cured foam agent may serve as an insulation material 83 of the door 80 for the refrigerator and be disposed in a space defined by the outer door 81 and a door liner 82.

In some implementations, the foam agent may be injected before an outer circumferential surface of the door liner 82 is coupled to the flange 77 of the outer door 81. Alternatively, the foam agent may be injected into the space defined by the door liner 82 and the outer door 81 through a hole defined in the door liner 82 after the door liner 82 is coupled to the flange 77.

In some examples, a gasket 84 for preventing cool air from leaking may be disposed on the door liner 82.

When the foam agent is injected into the outer door before the outer circumferential surface of the door liner 82 is coupled to the flange 77 of the outer door 81, the outer circumferential surface of the door liner 82 may be coupled to the flange 77 of the outer door 81 after the foam agent is injected.

Figure 13:
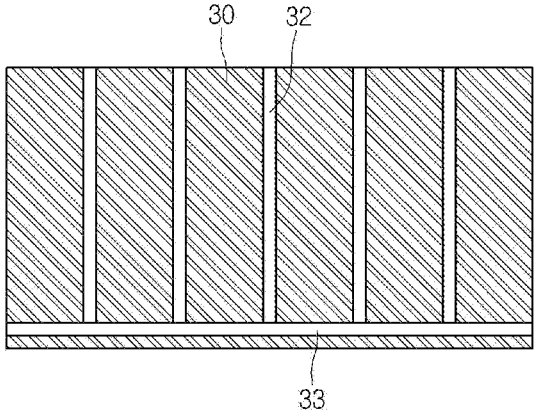
FIGS. 13 and 14 are views of an example press mold.
Figure 14:
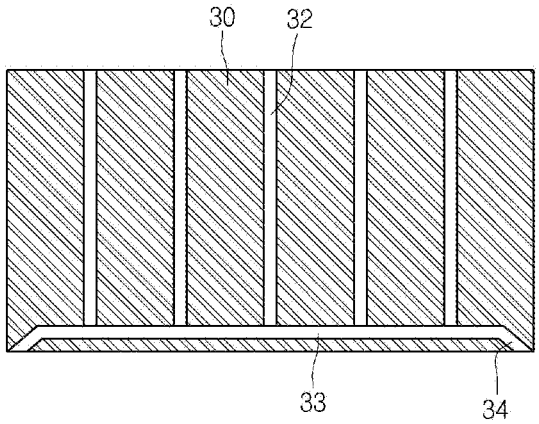

FIGS. 13 and 14 illustrate an example press mold. Although the first press mold is described as a press mold described below, the press mold may be equally applicable to the second press mold.

Referring to FIG. 13, a first press mold 30 may include a vertical passage 32 that extends in a vertical direction and a horizontal passage 33 that extends in a horizontal direction. An outlet of the horizontal passage 33 may be disposed in a side surface of the first press mold 30.

Air may successively flow into the vertical passage 32 and the horizontal passage 33 and then be supplied into a space between the press mold and a metal sheet.

Referring to FIG. 14, a first press mold 30 may include a vertical passage 32 that extends in a vertical direction, a horizontal passage 33 that extends in a horizontal direction, and an end passage 34 that extends from an end of the horizontal passage 33 toward a corner of a lower portion of a the first press mold 30.

According to some implementations, since the metal plate is pressed and deformed to integrate the first surface and the second to fifth surfaces with each other, processes of assembling and sealing a separate deco member for forming the circumferential parts of the outer door may not be necessary. Also, since the surfaces for forming the circumferential parts are integrated with each other, torsional strength of the outer door may be improved to reduce deformation of the outer door while the foam agent is injected into the outer door and expanded. In addition, an additional reinforcement material for improving strength of the outer door may not be necessary.

Further, since a separate deco member is not coupled to the outer door, a gap between the surfaces may not occur.

Also, since the metal sheet is processed through the hydro forming process, a large number of molds may not be required. In addition, the mold may be reduced in volume to reduce costs of investment in equipment. For instance, when a wide surface such as the door is processed, the process may prevent corner portions thereof from being torn due to a thin thickness thereof.

Also, when the metal sheet is deformed, a portion of the metal sheet may be bent and deformed by the pressing of the mold and the liquid to form the circumferential parts. Thus, since the liquid pressure is applied to only the deformed portion of the metal sheet, the pressing force and size of the mold may decrease to reduce the cost of equipment of the mold.

Although implementations have been described with reference to a number of illustrative examples thereof, it should be understood that numerous other modifications and implementations can be devised by those skilled in the art that will fall within the spirit and scope of the principles of this disclosure. More particularly, variations and modifications are possible in the component parts and/or arrangements and the variations and modifications fall within the scope of the disclosure, the drawings and the appended claims. In addition to variations and modifications in the component parts and/or arrangements, alternative uses will also be apparent to those skilled in the art.

What is claimed is:

1. A method for manufacturing a door, the method comprising:

fixing edge portions of a metal plate within a mold frame;

pressing and deforming the metal plate to manufacture an outer door of which a front surface, two side surfaces, a top surface, and a bottom surface are integrated with each other, and wherein the side surfaces, top surface, and bottom surface extend from the front surface in the same direction;

removing the edge portions from the outer door that were fixed within the mold frame during the pressing and deforming of the metal plate;

cutting away a portion of each corner of the side surfaces, the top surface, and the bottom surface;

bending edges of the side surfaces, the top surface, and the bottom surface of the outer door inwardly to define flanges at the side surfaces, the top surface, and the bottom surface of the outer door; and after defining the flanges at the side surfaces, the top surface, and the bottom surface of the outer door, injecting a foam agent into a space defined by the side surfaces, the top surface, the bottom surface, and the flanges of the outer door, wherein the flanges include four flanges, and each end portion of the four flanges is spaced apart from the remainder of the flanges, and wherein the corners of each of the four flanges do not overlie with any other flange corners.

2. The method according to claim 1, further comprising connecting a door liner to the outer door after injecting the foam agent.

3. The method according to claim 2, further comprising coupling, to the door liner, a gasket configured to create a seal based on the door contacting a refrigerator cabinet in a closed position.

4. The method according to claim 2, further comprising, prior to connecting the door liner to the outer door, allowing the injected foam agent to cure, the cured foam agent being configured to act as an insulating material.

5. The method according to claim 2, further comprising attaching a gasket to the door liner, the gasket being configured to prevent the leakage of cool air when the door is installed on a refrigerator cabinet.

6. The method according to claim 1, further comprising, prior to injecting the foam agent, installing a packing between each pair of adjacent flanges, the packing being configured to block leakage of the foam agent injected into the space defined by the surfaces and flanges of the outer door.

7. The method according to claim 1, further comprising connecting a door liner to the outer door before injecting the foam agent, wherein injecting the foam agent comprises injecting the foam agent into a space defined between the outer door and the door liner through a hole of the door liner.

8. The method according to claim 1, further comprising connecting a door liner to the four flanges after injecting the foam agent.

9. The method according to claim 1, wherein pressing and deforming the metal plate comprises using a hydro forming process to press and deform the metal plate.

10. The method according to claim 1, wherein bending edges of the side surfaces, the top surface, and the bottom surface of the outer door inwardly to define flanges at the side surfaces, the top surface, and the bottom surface of the outer door comprises bending the edges of the side surfaces, the top surface and the bottom surface so that each flange has a length that is shorter than a length of the surface from which it is bent.

* * * * *